US011285352B2

(12) United States Patent
Beall

(10) Patent No.: US 11,285,352 B2
(45) Date of Patent: Mar. 29, 2022

(54) METHOD OF EXERCISE USING TWO-HANDLED CONTAINER PARTIALLY FILLED WITH LIQUID

(71) Applicant: William Gary Beall, St. Marys, GA (US)

(72) Inventor: William Gary Beall, St. Marys, GA (US)

( * ) Notice: Subject to any disclaimer, the term of this patent is extended or adjusted under 35 U.S.C. 154(b) by 0 days.

(21) Appl. No.: 16/751,204

(22) Filed: Jan. 23, 2020

(65) Prior Publication Data

US 2021/0228931 A1 Jul. 29, 2021

(51) Int. Cl.
*A63B 21/06* (2006.01)
*A63B 21/00* (2006.01)

(52) U.S. Cl.
CPC .... *A63B 21/0602* (2013.01); *A63B 21/00196* (2013.01); *A63B 21/4035* (2015.10); *A63B 21/0004* (2013.01); *A63B 21/4043* (2015.10)

(58) Field of Classification Search
CPC ..... A63B 21/0004; A63B 21/00196; A63B 21/0602; A63B 21/4035; A63B 21/4043
See application file for complete search history.

(56) References Cited

U.S. PATENT DOCUMENTS

| | | | | |
|---|---|---|---|---|
| 3,756,592 | A * | 9/1973 | Johnson | A61H 23/06 482/110 |
| 3,843,117 | A * | 10/1974 | Johnson | A63B 21/0602 482/110 |
| 5,393,285 | A * | 2/1995 | Fischer, Sr. | A63B 21/0602 482/106 |
| 5,857,946 | A | 1/1999 | Brown | |
| 6,068,580 | A | 5/2000 | Myers et al. | |
| 7,141,012 | B2 * | 11/2006 | Lin | A63B 21/0004 482/126 |
| 8,128,537 | B2 | 3/2012 | Signorile et al. | |
| 8,911,334 | B1 * | 12/2014 | Cotter | A63B 21/0602 482/111 |
| 9,623,274 | B2 | 4/2017 | Holt, IV et al. | |
| 2013/0267390 | A1 | 10/2013 | Warren | |
| 2014/0256522 | A1 * | 9/2014 | Holt, IV | A63B 21/4035 482/110 |
| 2015/0141220 | A1 | 5/2015 | Wargo | |
| 2016/0303451 | A1 * | 10/2016 | Holland | A63B 41/00 |
| 2017/0001060 | A1 * | 1/2017 | D'Alesio | A63B 21/0602 |
| 2020/0054916 | A1 * | 2/2020 | Brummond | A63B 71/0622 |

* cited by examiner

*Primary Examiner* — Joshua Lee
(74) *Attorney, Agent, or Firm* — Mark Young, PA

(57) ABSTRACT

A method of exercise includes partially filling (not more than 70% full) a symmetrical hollow body of an exercise device with water, grasping a pair of opposed handles attached to the hollow body, positioning the device at a height and orientation for a first set of motions, and rapidly oscillating the device at a frequency (≥2 HZ) to transform the water from a static state into a dynamic state in which the center of mass oscillates and hydrodynamic forces arise. Optionally, an additive such as viscosity enhancer or beads for audible effect may be introduced in the water.

19 Claims, 14 Drawing Sheets

METHOD OF EXERCISE USING TWO-HANDLED CONTAINER PARTIALLY FILLED WITH LIQUID

FIELD OF THE INVENTION

This invention relates generally to a method of exercise, and, more particularly, to a method of exercise that involves transforming the state of liquid in a two-handled container from static to dynamic by imparting relatively high frequency oscillating linear translational or orbital motion to the container.

BACKGROUND

Research shows that even moderate-intensity aerobic activity, muscular strength and endurance training, and flexibility training will improve both physical and mental health. The benefits of physical activity include improved energy and decreased fatigue; better sleep; reduced depression, tension, anxiety, and stress; improved mood and self-esteem; improved cardiovascular fitness; increased muscle strength and endurance; improved freedom of movement and posture, increased metabolism and ability to maintain weight; and reduced risk for chronic disease and other adverse health outcomes.

In recent years there has been great interest in combining aerobic activity with muscular strength and endurance training and flexibility training. To achieve such a combination, complex machines have been devised. These machines require movements that mimic running, skiing, rowing, climbing. Many such machines include elements that resist motion, such as pivoting poles. While such machines may facilitate quality exercise, they occupy considerable space, they are costly, they become monotonous over time, and some of the many parts of these complex machines eventually fail. Often such machines are discarded, relegated to a basement or other storage space, or sold for a deep discount at a garage sale or local online marketplace.

An easy to use, compact, inexpensive, reliable exercise device and method of use are needed for aerobic activity combined with muscular strength and endurance training and flexibility training are needed. The device and method should allow a wide range of motions to avoid monotony and to benefit a range of muscle groups.

The invention is directed to overcoming one or more of the problems and solving one or more of the needs as set forth above.

SUMMARY OF THE INVENTION

To solve one or more of the problems set forth above, in an exemplary implementation of the invention, an exercise device includes a thin walled container with a pair of handles. The handles are opposed. The container includes a port for partially filling the interior volume of the container with a volume water. A removable or sealable closure is provided to securely seal the port. The container may be emptied and collapsed to facilitate storage, such as for travel.

An exemplary method of exercise according to principles of the invention entails partially filling the container with water, securely sealing the port, grasping the handles with one hand per handle, lifting the partially filled container by the handles and rapidly moving the partially filled container to transform its contents from a static state to a sloshing state. The movement may be harmonic linear translation or orbital motion. The movement is performed at a relatively high frequency, such as 2 to 4 Hz. The movements are continued for a determined period of time to complete a set. During a set of one minute, 120 repetitions (cycles) are achieved at 2 Hz.

In one embodiment, a method of exercise according to principles of the invention includes partially filling an exercise device with water. The exercise device has a hollow body with an internal compartment having a volume, a pair of handles, a fill port in the hollow body, and a plug in the fill port. The handles may be separately formed from the hollow body or integrally formed with the hollow body, such as by molding (e.g., rotational molding). The hollow body is symmetrical about two perpendicular planes. The pair of handles are on opposite sides of the hollow body. The water partially filling the internal compartment occupies no more than 70% of the total volume of the internal compartment. The volume is about (+/− 5%) 110 cubic inches to 1450 cubic inches. The exercise device with the hollow body partially filled with water has a weight from about 2.9 lbs to 22.9 lbs. If the hollow body is spherical, it may have an outer diameter of about 6 to 14 inches. Each handle is grasped. The exercise device is lifted and positioned at a determined height and orientation. Then the exercise device is moved in an oscillating manner (e.g., linear or orbital) at a frequency of at least 2 Hz (preferably at least 2.5 Hz) to transform the water in the internal compartment to a dynamic state producing hydrodynamic forces and an oscillating center of mass. This motion may be continued for a determined time or a determined number of repetitions (e.g., cycles), comprising a set.

In one embodiment, the hollow body is comprised of a flexible material initially in a collapsed condition. The hollow body is transformed (e.g., inflated or otherwise manipulated) into an uncollapsed configuration before introducing water into the internal compartment.

In one embodiment, the step of partially filling entails adding, to the water, an additive. The additive may be a viscosity modifier to increase viscosity. Alternatively, the additive may be beads for producing an audible effect in the dynamic state.

The device can be fluidly moved to an infinite number of positions while maintaining the high frequency movements. After completing a first set, the exercise device may be repositioned to another height and/or orientation for a second set. In the second set, the repositioned exercise device is moved again in an oscillating manner at a frequency of at least 2 Hz to transform the water in the internal compartment to a dynamic state producing hydrodynamic forces, until the second set is completed as determined by a period of time or number of cycles.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

A method of exercise according to principles of the invention transforms the state of liquid in a two-handled container from static to dynamic by imparting relatively high frequency oscillating linear translational or orbital motion to the container. FIGS. 1-4 conceptually illustrate such an exemplary two-handled container 100.

The exemplary container 100 is a spherical shell 105 with a port 120 and a pair of handles 110, 115. The invention is not limited to a spherical shaped body. Other shapes including, but not limited to, cylinder, torus, octahedron, icosahedron, dodecahedron, and cube shapes may be utilized without departing from the scope of the invention. Preferably the shape is symmetrical about each of two intersecting perpendicular planes (e.g., a horizontal plane and a vertical plane). Regardless of the shape, the body is a hollow thin-shelled structure that defines an interior compartment for containing a liquid.

In the exemplary embodiment, the spherical shell 105 is sufficiently rigid to maintain its shape during filling. Additionally, in the exemplary embodiment, the spherical shell 105 is flexible enough to collapse for compact storage during packaging and transportation.

A port 120 is provided in the spherical shell 105. Liquid (e.g., water) may be introduced into and drained from the interior compartment through the port 120. A plug or valve is applied to seal the port 120 and prevent leakage of liquid during use. A plug or valve may be threadedly received, coupled by snap-fit connection or press fit into the port 120.

Figure 14:
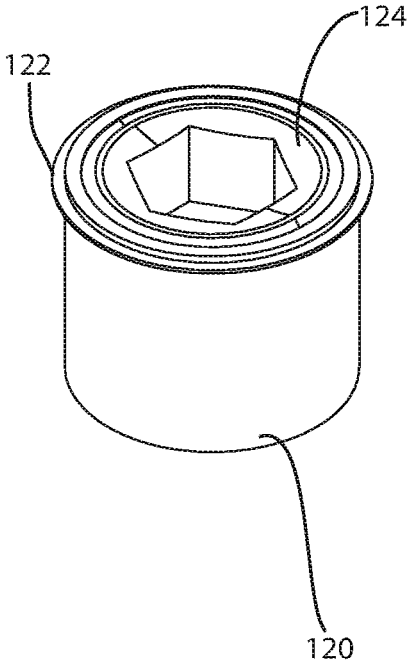
FIG. 14 is a schematic of an exemplary fill port in a closed configuration.
Figure 15:
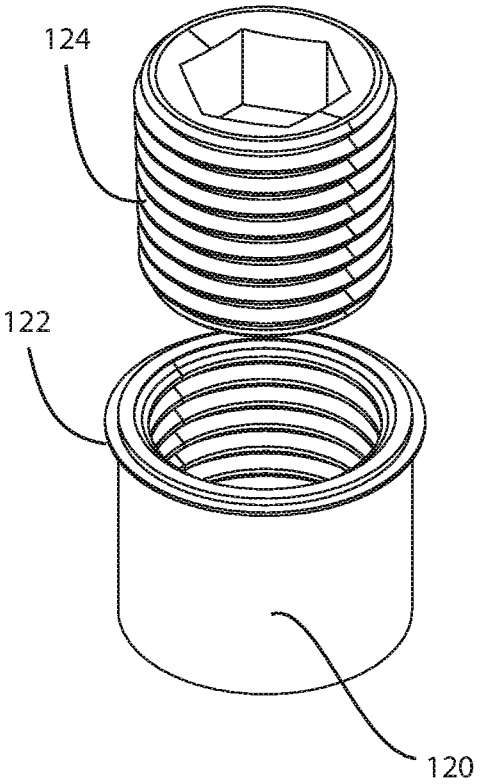
FIG. 15 is a schematic of an exemplary fill port in an open configuration.

FIGS. 14 and 15 conceptually illustrate a non-limiting example of a suitable fill port 120. The port 120 may be molded into the spherical shell 105. The port 120 is an internally threaded sleeve, that receives an externally threaded plug 124. In the closed position, the plug 124 is threaded into the sleeve 120, as in FIG. 11. In the open position, the plug 124 is removed from the sleeve 120. The sleeve 120 may include a flange 122 or other feature for overmolding when the port is molded into the spherical shell 105. The port may be produced using any method of manufacture suitable for the chosen material. By way of example, a plastic port and plug may be molded, such as injection molded. An aluminum port and plug may be machined or cast. The port may then be loaded into a mold for producing the hollow body (e.g., spherical shell 105). Thus, the port may be overmolded into the spherical shell 105.

Prior to use, the spherical shell 105 is partially filled with water. The relative volume of water is discussed below. After the determined amount of water, and any additive or beads, have been introduced into the interior compartment of the spherical shell 105, the port 120 is sealed with the plug.

Optionally, additives may be introduced into the water in the container. By way of example, viscosity modifiers may be added to the water to affect the flow properties. Such viscosity modifiers may include soluble polymers such as Dextran, PVP (polyvinylpyrrolidone), PEG (polyethylene glycol); gelatin; or plant resins such as gum accacia. Increased viscosity creates increased resistance to flow and increased shear stress at the liquid wall interface. The increased stress equates to increased shear forces. Other additives may include buoyant beads to provide a distinctive palpable and audible effect that facilitates tracking repetitions.

The spherical shell 105 is partially filled. Partial filling provides space within the spherical shell 105 for sloshing flow that generates hydrodynamic forces and an oscillating center of mass to complement the force of weight. If filled to capacity, sloshing is prevented, which would prevent practicing a method of exercise according to principles of the invention. While the invention is not limited to a particular level of filling, a fill range of 25% to 75% (percent by volume) is preferred. A fill range of 30% to 70% is more preferred. A fill range of 40% to 60% is particularly preferred. Each of these levels of fill provide space (at least 30% of the total volume) in which appreciable hydrodynamic forces and an oscillating center of mass may be generated. Unless otherwise specified, partially filled, as used herein, means filled to no more than 70%. Partially filled weights of about 2.9 lbs to 22.9 lbs are preferred.

The size of the hollow body (e.g., spherical shell 105) may vary. Spherical diameters (i.e., inner diameter) of 6 to 14 inches are preferred. Volumes of 110 cubic inches to 1450 cubic inches are preferred.

Weightlifters prefer heavy static weights. To maximize weight and prevent shifting of contents of a fillable weight, a weightlifter would be motivated to fill the fillable weight to about capacity. Such filling would not work for the subject invention, as it would prevent sloshing flow that generates appreciable hydrodynamic forces and an oscillating center of mass in response to high frequency oscillating motion.

Concomitantly, at a fill fraction above 0.75, there is less room for sloshing and a smaller percentage of the liquid mass may be considered a "swinging" pendulum mass. Thus, filling to capacity or nearly to capacity would render the device unusable for a method of exercise according to principles of the invention.

The handles 110, 115 are positioned on opposite sides of the spherical shell 105. Each handle 110, 115 and the spherical shell 105 are bisected by an imaginary plane (e.g., a horizontal plane). Each handle 110, 115 and the spherical shell 105 is symmetrical about the bisecting plane.

The handles 110, 115 are generally C-shaped and equal in size. Each handle 110, 115 includes a lateral gripping portion 113, 118, and a pair of joints 111, 112 and 116, 117. The joints 111, 112 and 116, 117 define the points of attachment of each handle 110, 115 to the spherical shell 105. Each handle 110, 115 defines a space 114, 119 between the lateral gripping portion 113, 118 and the spherical shell 105. Each such space 114, 119 is sufficient in size to receive fingers and a thumb of a user's hand grasping the lateral gripping portion 113, 118.

The handles 110, 115 may be thin shelled (i.e., hollow) or solid structures. The handles 110, 115 may be formed separately from the spherical shell 105 or integrally formed with the spherical shell 105. If separately formed, the handles may be attached to the spherical shell 105 at the joints 111, 112 and 116, 117, by bonding, welding (e.g., ultrasonic welding) and/or mechanical fastening. Alternatively, separately formed handles may be overmolded to the spherical shell 105. If integrally formed, the handles 110, 115 may be produced using the same material and process that is used to form the spherical shell 105.

The exercise device 100 may be produced using any suitable manufacturing techniques known in the art for the chosen material, such as (for example) rotational molding, injection molding, compression molding, structural foam molding, blow molding, or transfer molding; polyurethane foam processing techniques; and vacuum forming. Preferably the manufacturing technique is suitable for mass production at relatively low cost per unit, and results in an aesthetically acceptable product with a consistent acceptable quality and structural characteristics.

In one preferred embodiment, the device 100 is formed by rotational molding of a thermoplastic polymer. Such a process entails loading a measured quantity of thermoplastic polymer (usually in powder form) into the mold. Then the mold is heated in an oven while it rotates, through two or more axes, until all the polymer has melted and evenly adhered to the mold wall. The mold is then cooled at a controlled rate, such as by a fan, until the melted thermoplastic solidifies and can be handled safely by an operator. Then the part is removed.

A device according to principles of the invention is not limited to any particular wall thickness. In an exemplary embodiment the wall thickness is at least about 1/32-inch (0.8 mm). Rotational molding allows adjustment of wall thickness even after the mold has been made. Wall thickness may be adjusted to achieve a desired balance of flexibility and rigidity. In a preferred implementation, the hollow body is collapsible for packaging and storage, but may readily be un-collapsed (i.e., inflated or otherwise restored to its full shape) for filling and use.

Various features may be incorporated into the molded device. Rotational molding allows for special features to be molded into the parts, including molded in threaded inserts, molded in plastic or aluminum features, such as ports and handles or even carbon or stainless steel components. A fill port (e.g., a threaded fill port or other fill port) may be molded into the device. Stiffening features, such as latitudinal and/or longitudinal ribs may be formed on the outer surface of the device.

Nonlimiting examples of materials that may be used include low-density polyethylene (LDPE), linear low-density polyethylene (LLDPE), high-density polyethylene (HDPE), and regrind, as well as PVC plastisols, nylons, and polypropylene. The rotomolded product is preferably flexible enough to allow collapsing of the container for compact packaging, shipping and storing.

Figure 1:
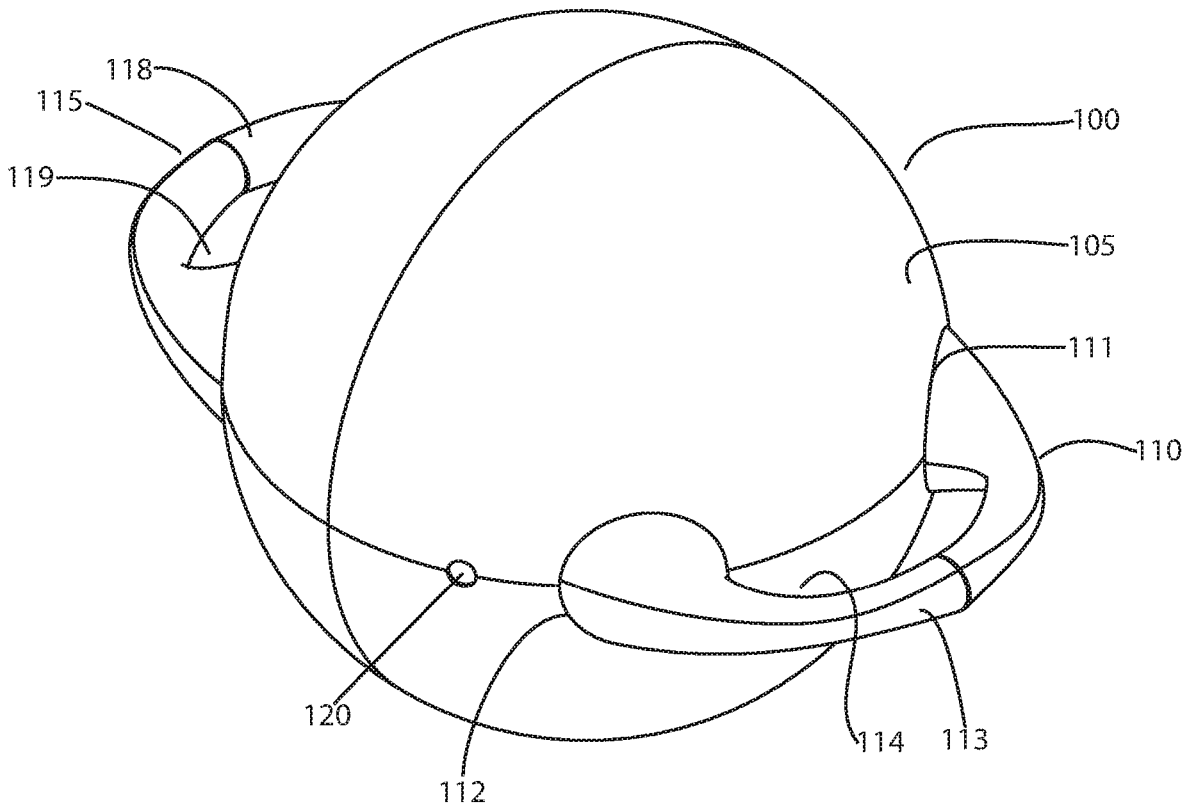
FIG. 1 is a top perspective view of an exemplary exercise device according to principles of the invention.
Figure 2:
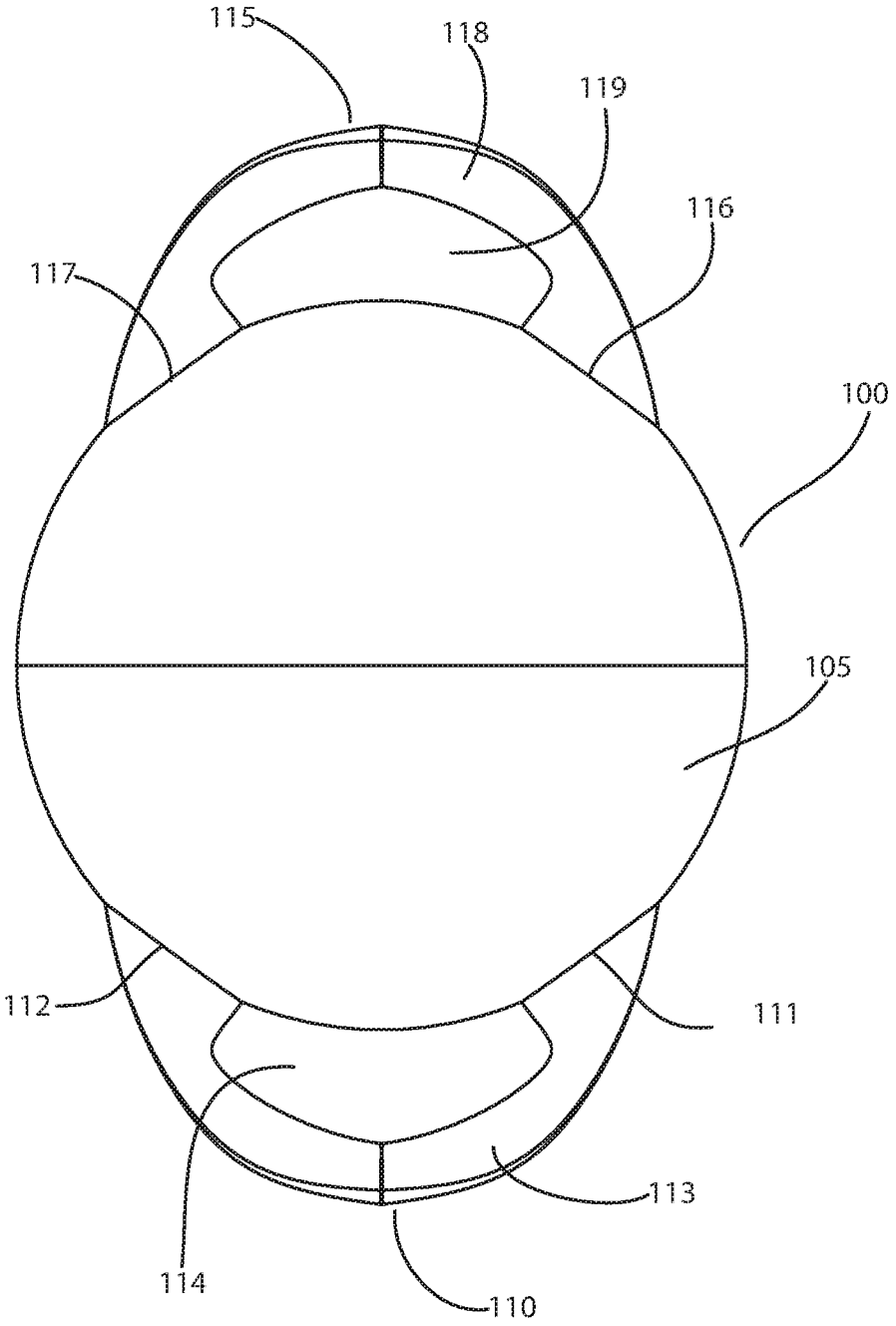
FIG. 2 is a plan view of an exemplary exercise device according to principles of the invention.
Figure 3:
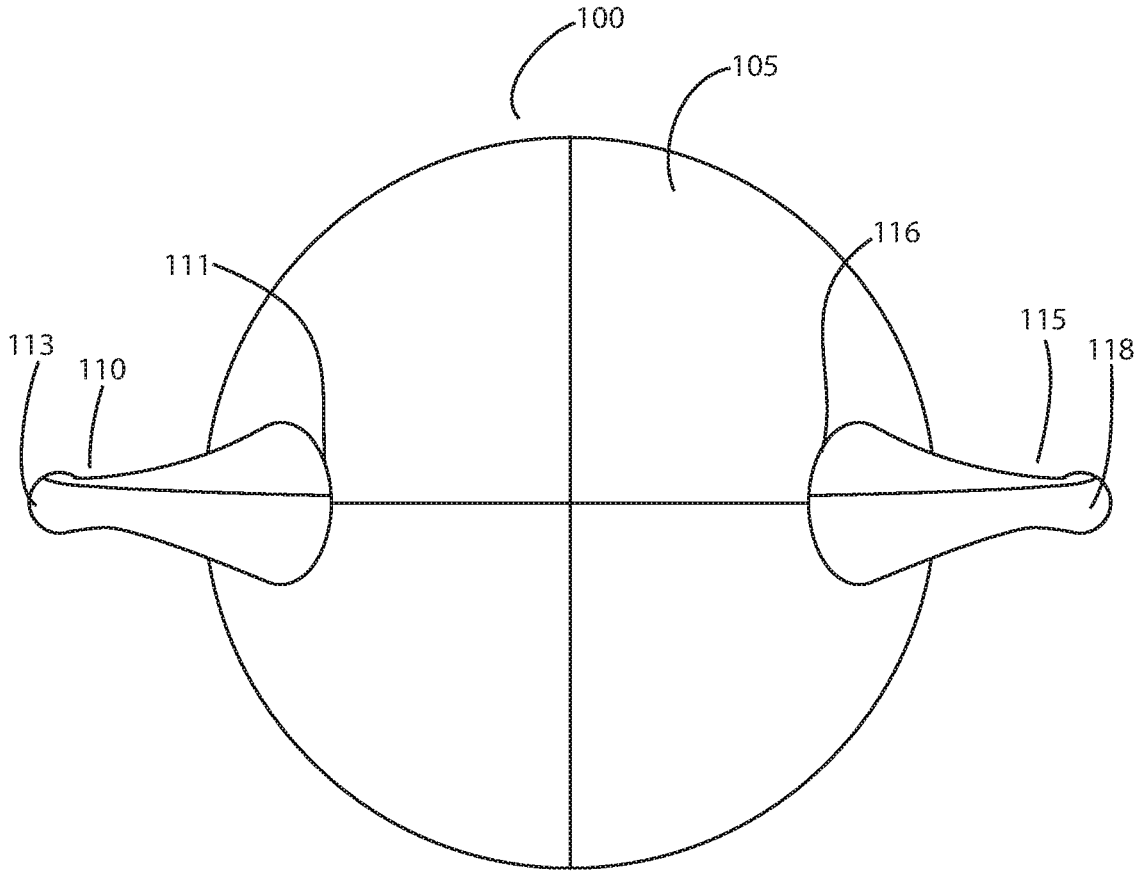
FIG. 3 is a front view of an exemplary exercise device according to principles of the invention.
Figure 4:
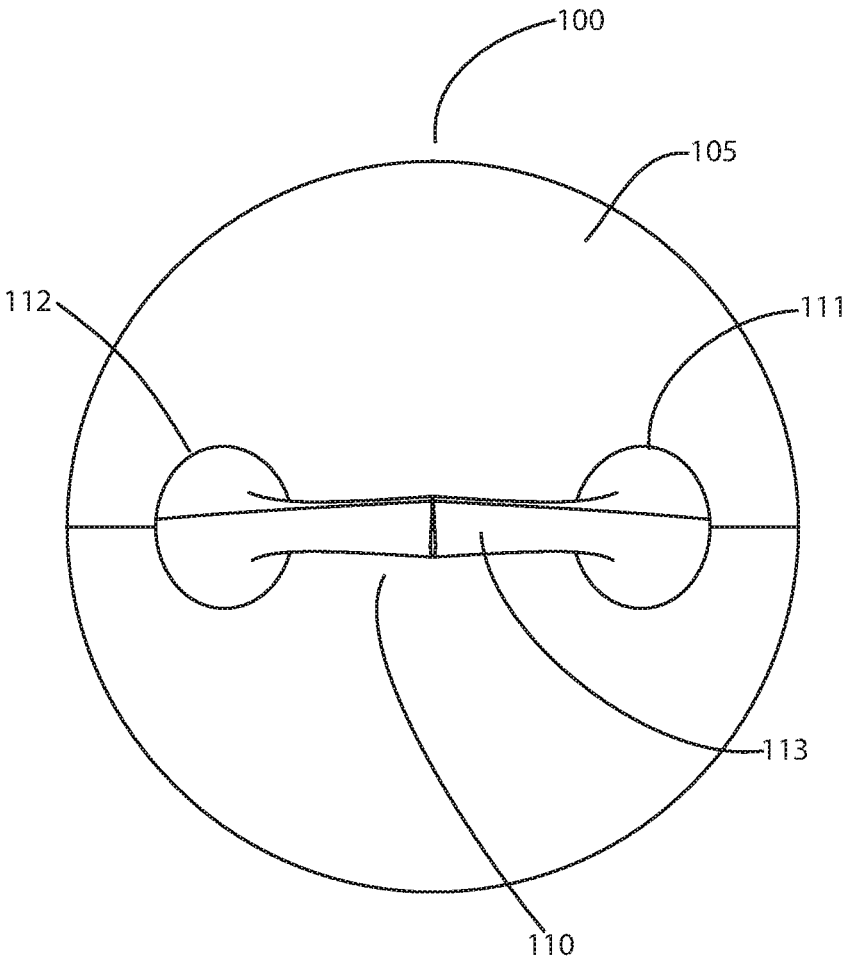
FIG. 4 is a side view of an exemplary exercise device according to principles of the invention.
Figure 5:
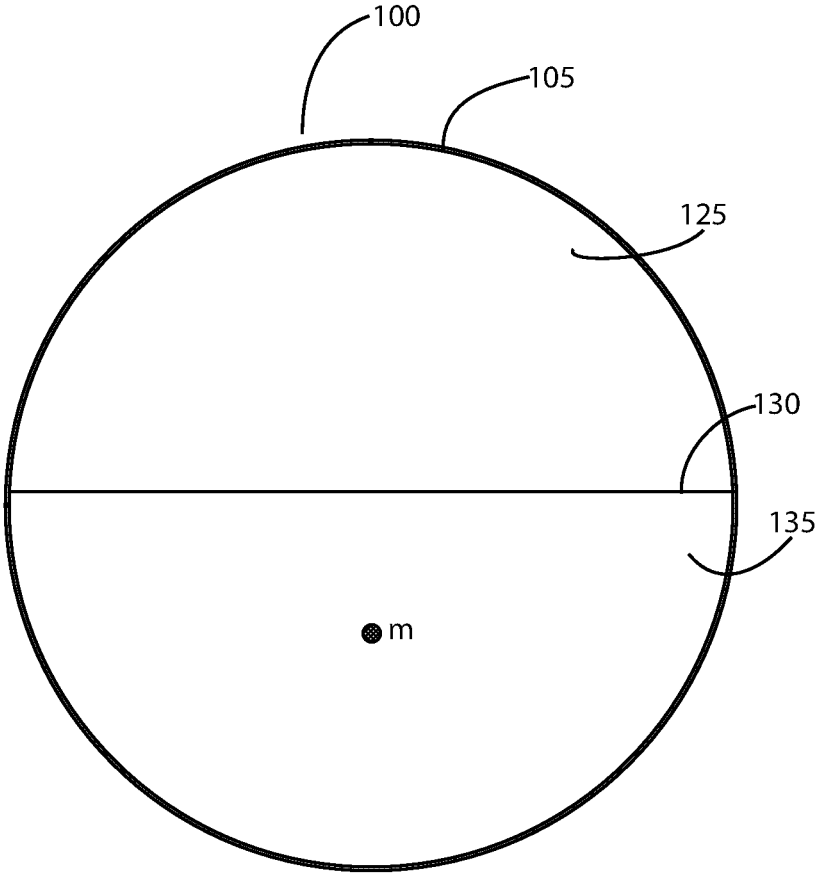
FIG. 5 is a schematic that conceptually illustrates a section of a partially filled container for an exemplary exercise device according to principles of the invention, with the contents in a static state.
Figure 6:
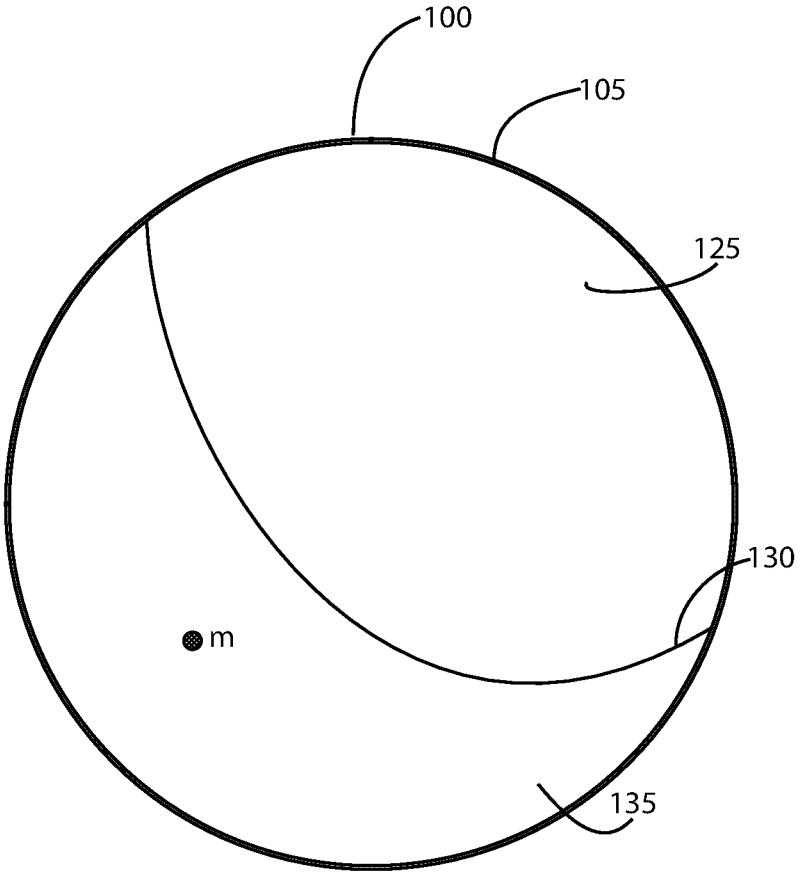
FIG. 6 is a schematic that conceptually illustrates a section of a partially filled container for an exemplary exercise device according to principles of the invention, with the contents in a dynamic state.
Figure 7:
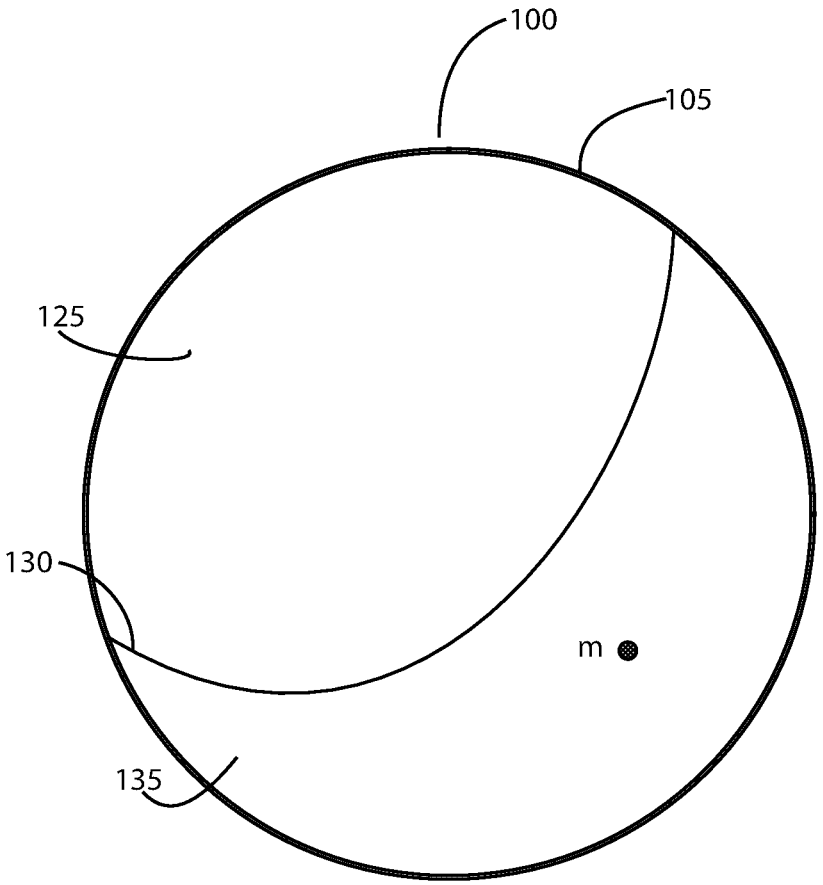
FIG. 7 is another schematic that conceptually illustrates a section of a partially filled container for an exemplary exercise device according to principles of the invention, with the contents in a dynamic state.

FIGS. 5 through 7 schematically illustrate a section of the spherical shell 105, partially filled with water, in various states, according to principles of the invention. The different states include a substantially static state with no appreciable hydrodynamic forces from flow of the liquid (i.e., a static state), and a dynamic state with appreciable hydrodynamic forces from flow of the liquid (i.e., a dynamic state). During use of the device, a user imparts oscillating excitation forces at a relative high frequency to transform the contents from a static state to a dynamic state.

Extensive research has been conducted on forces exerted by sloshing of liquids in oscillated containers of various shapes. See, for example, H. Norman Abramson, *The Dynamic Behavior of Liquids in Moving Containers: with Application to Space Vehicle Technology*, NASA SP-106, N67-1 5884, Accession No. 67N15885 (1966). The vast majority of prior research efforts has been directed at determining forces as a function of several variables, including container shape, excitation forces, fill depth, liquid properties and other system characteristics. The objective of such prior research was to improve the understanding of sloshing so that the hydrodynamic forces exerted by sloshing liquid may be dampened, counteracted or avoided. Ships at sea, liquid propellant rockets, spacecraft, aircraft and tanker vehicles, have benefited from a keen understanding of the complex of forces unleashed by motion of liquid in a container.

The objective, here, is quite different. Rather than suppress, dampen, minimize or avoid hydrodynamic forces, a method according to principles of the invention generates and harnesses such forces to efficiently exercise muscle groups. The forces are generated by rapidly oscillating a container according to principles of the invention. In so doing, the liquid contents, which partially fill the container, are physically transformed, by the user, from a static state to a dynamic state in which hydrodynamic pressures, changing momentum, and other dynamic characteristics produce a complex of forces for effective exercise.

A user supports the weight of the container and its liquid contents. The liquid contents partially fill the container. As the user oscillates the container, the liquid in the partially filled container undergoes sloshing motion. Oscillating motion of the container physically transforms the contained liquid from substantially static to dynamic, characterized by liquid sloshing. In the transformed state, the liquid interacts with the container. The center of mass of the liquid moves within the container. The momentum of the liquid varies in direction and magnitude. Hydrodynamic pressures and moments arise from liquid oscillations in the container and interactions between the liquid and the interior wall of the container. The net result is that in addition to supporting the weight of the container and its contents, a user must resist hydrodynamic forces and moments that arise from liquid oscillations in the container. While the force from the mass of the container and its contents is directed downward, the hydrodynamic forces and moments that arise from liquid oscillations in the container may be directed elsewhere, such as toward, away from or lateral to the user. The complex of forces engages more muscle groups and affects the engaged muscle groups more profoundly than the weight alone.

In the schematic of FIG. 5 for a static state, the liquid 135 partially fills the interior space 125 of the spherical shell 105. The liquid-gas interface 130 is horizontal and substantially stationary. The center of mass m is located in line with the vertical plane that bisects the spherical shell 105. In the schematic of FIG. 6, the spherical shell 105 has been rapidly accelerated leftward. The center of mass m has shifted to the left. Liquid flows along and collides with walls of the spherical shell 105 on the left hemisphere. The flow and collision cause hydrodynamic forces in the left hemisphere. In the schematic of FIG. 7, the spherical shell 105 has been rapidly accelerated rightward. The center of mass m has shifted to the right. The movement of the center of mass is similar to the movement of a pendulum. Concomitantly, liquid flows along and collides with walls of the spherical shell 105 on the right hemisphere. The flow and collision cause hydrodynamic forces in the right hemisphere. A method of exercise according to principles of the invention entails providing rapid oscillating and/or orbital excitation motions that cause rapid and repeated shifting of the center of mass of the liquid coupled with hydrodynamic forces.

An effective frequency for the oscillating or orbital motion is 2 Hz to 4 Hz. A particular preferred frequency is 2.5 Hz. The frequency can be determined by counting the cycles in a determined time period. For example, a user may count 25 cycles completed in 10 seconds to conclude that the user is oscillating at the preferred 2.5 Hz. At 2.5 Hz, sloshing water in the spherical shell 105 produces considerable hydrodynamic forces. Thus, in addition to resisting the weight and changing momentum of the device, at 2.5 Hz a user resists the appreciable hydrodynamic forces.

In sharp contrast to the slow repetitions of traditional weight training, the rapid high frequency motions of a method of exercise according to principles of the invention transform the liquid contents of the partially filled spherical shell 105 from a static state to a dynamic state, as described above. Hydrodynamic forces arise in the dynamic state, intensifying the workout. Concomitantly, the high frequency achieves many repetitions in a short period of time.

Figure 8:
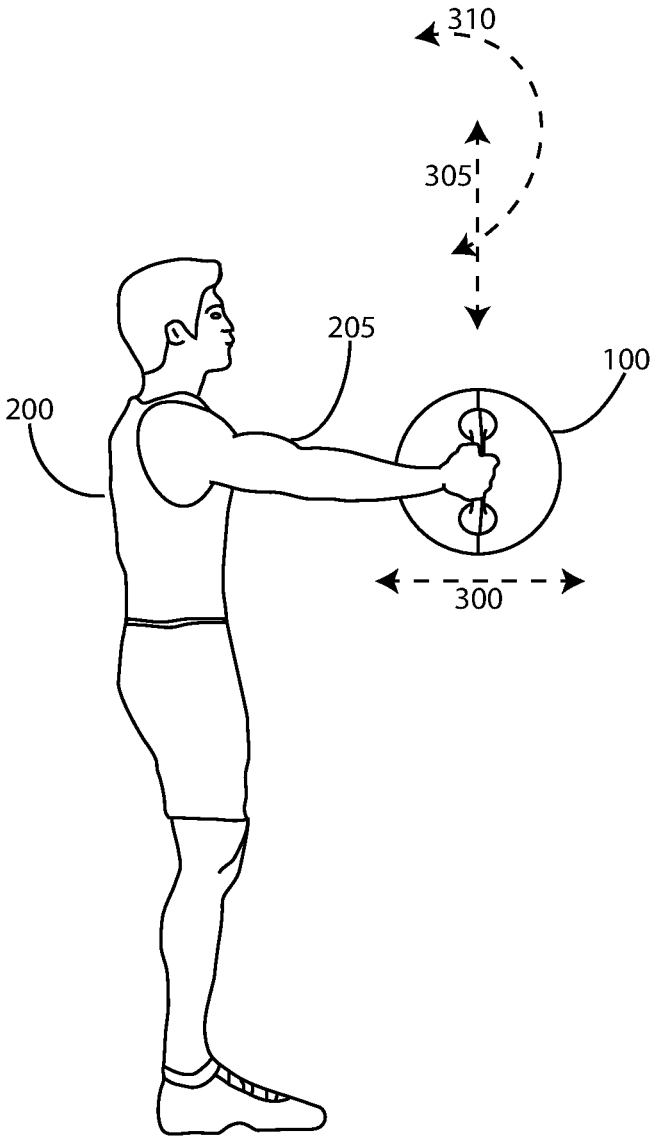
FIG. 8 is a schematic that conceptually illustrates a user performing a method of exercise using an exemplary exercise device according to principles of the invention.
Figure 9:
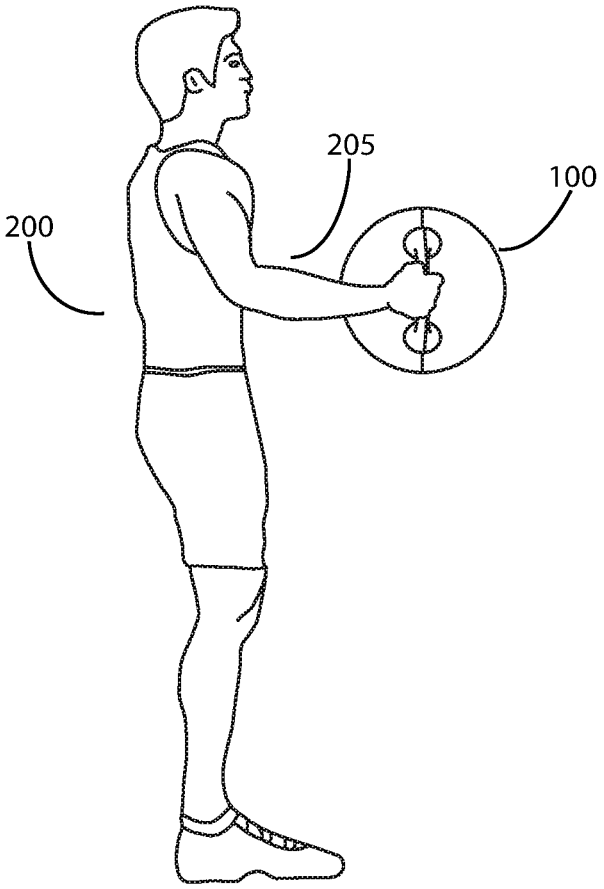
FIG. 9 is another schematic that conceptually illustrates a user performing a method of exercise using an exemplary exercise device according to principles of the invention.

FIGS. 8 and 9 conceptually illustrates a user performing a method of exercise using an exemplary exercise device according to principles of the invention. After the spherical 105 has been partially filled with water and any optional additive(s), the port is closed. Grasping the handles 110, 115, the user 200 lifts the device 100. With arms 205 fully or partially extended, the user commences high frequency oscillating or orbital motion. By way of example and not limitation, the motion may be substantially linear horizontal 300, linear vertical 305, orbital 310, linear in a plane other than horizontal or vertical, or orbital about an axis other than an axis that lies in the horizontal or vertical plane. During an exercise session, a user may perform various sets of motions, including sets of different motions. For example, a user may first perform a set of linear oscillating motions followed by a set of orbital motions. The user may vary extension of their arms 205, from fully extended to partially extended. For example, the user may perform linear or orbital oscillations, moving the device from against the user's chest to a distance away whereby the user's arms are only partially extended, or substantially fully extended, or fully extended. Additionally, a user may perform oscillating motions while fully extending one and only partially extending the other arm. In all motions for a method according to principles of the invention, the user oscillates the device 100 at a high frequency to transform the liquid contents from a static state to a dynamic state in which hydrodynamic forces are generated.

Figure 10:
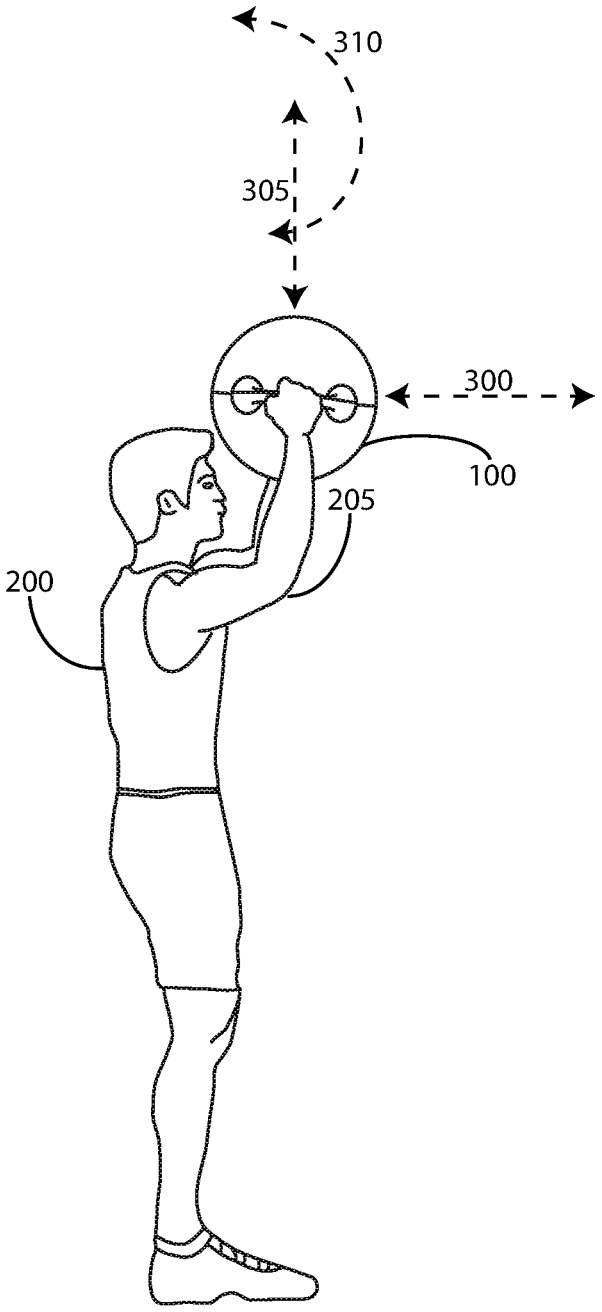
FIG. 10 is another schematic that conceptually illustrates a user performing a method of exercise using an exemplary exercise device according to principles of the invention.

FIG. 10 conceptually illustrates a user performing a method of exercise using an exemplary exercise device according to principles of the invention positioned overhead. After the spherical 105 has been partially filled with water and any optional additive(s), the port is closed. Grasping the handles 110, 115, the user 200 lifts the device 100. With arms 205 fully or partially extended, the user commences high frequency oscillating or orbital motion. By way of example and not limitation, the motion may be substantially linear horizontal 300, linear vertical 305, orbital 310, linear in a plane other than horizontal or vertical, or orbital about an axis other than an axis that lies in the horizontal or vertical plane. During an exercise session, a user may perform various sets of motions, including sets of different motions. For example, a user may first perform a set of linear oscillating motions followed by a set of orbital motions. The user may vary extension of their arms 205, from fully extended to partially extended. For example, the user may perform linear or orbital oscillations, moving the device from against the user's chest to a distance away whereby the user's arms are only partially extended, or substantially fully extended, or fully extended. Additionally, a user may perform oscillating motions while fully extending one and only partially extending the other arm. In all motions for a method according to principles of the invention, the user oscillates the device 100 at a high frequency to transform the liquid contents from a static state to a dynamic state in which hydrodynamic forces are generated.

Figure 11:
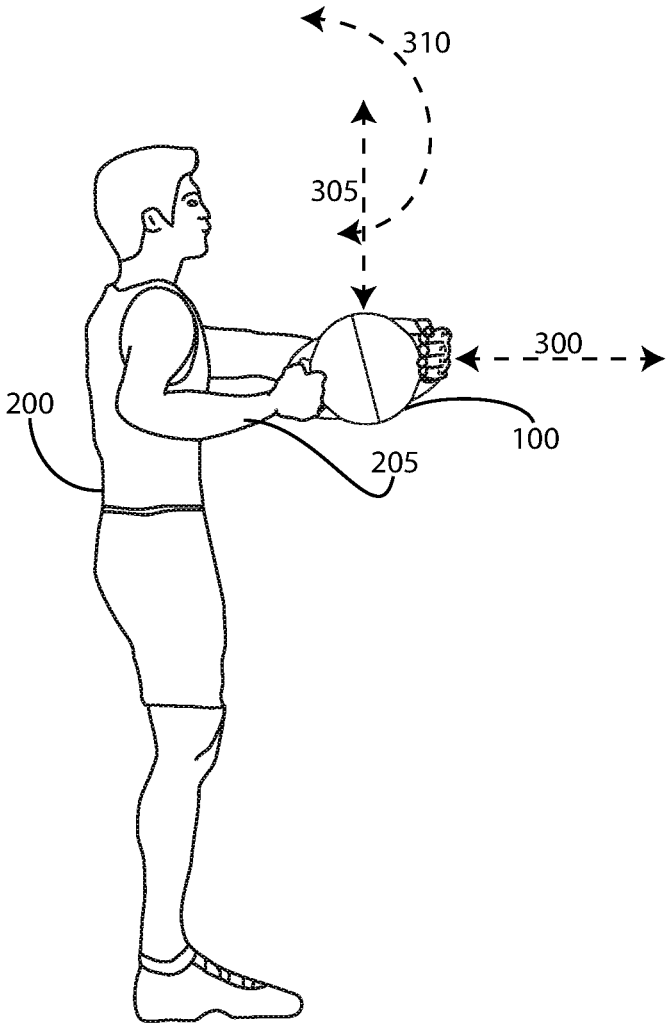
FIG. 11 is another schematic that conceptually illustrates a user performing a method of exercise using an exemplary exercise device according to principles of the invention.

FIG. 11 conceptually illustrates a user performing a method of exercise using an exemplary exercise device according to principles of the invention. After the spherical 105 has been partially filled with water and any optional additive(s), the port is closed. Grasping the handles 110, 115, the user 200 lifts the device 100. With one arm 205 extended less than the other arm, the user commences high frequency oscillating or orbital motion. By way of example and not limitation, the motion may be substantially linear horizontal 300, linear vertical 305, orbital 310, linear in a plane other than horizontal or vertical, or orbital about an axis other than an axis that lies in the horizontal or vertical plane. During an exercise session, a user may perform various sets of motions, including sets of different motions. For example, a user may first perform a set of linear oscillating motions followed by a set of orbital motions. The user may vary extension of their arms 205, from fully extended to partially extended. For example, the user may perform linear or orbital oscillations, moving the device from against the user's chest to a distance away whereby the user's arms are only partially extended, or substantially fully extended, or fully extended. Additionally, a user may perform oscillating motions while fully extending one and only partially extending the other arm. In all motions for a method according to principles of the invention, the user oscillates the device 100 at a high frequency to transform the liquid contents from a static state to a dynamic state in which hydrodynamic forces are generated.

Figure 12:
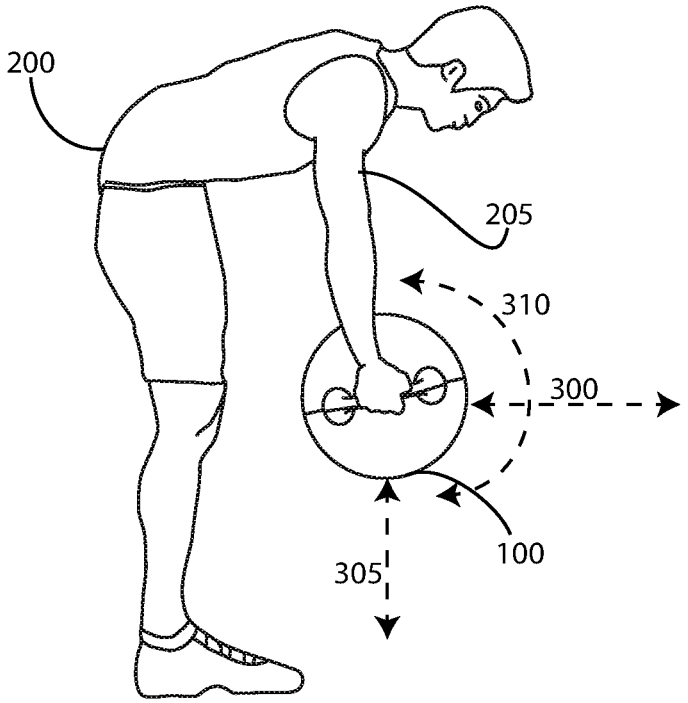
FIG. 12 is another schematic that conceptually illustrates a user performing a method of exercise using an exemplary exercise device according to principles of the invention.

FIG. 12 conceptually illustrates a user performing a method of exercise using an exemplary exercise device according to principles of the invention with the user bent over. After the spherical 105 has been partially filled with water and any optional additive(s), the port is closed. Grasping the handles 110, 115, the user 200 lifts the device 100. With arms 205 fully or partially extended, the user commences high frequency oscillating or orbital motion. By way of example and not limitation, the motion may be substantially linear horizontal 300, linear vertical 305, orbital 310, linear in a plane other than horizontal or vertical, or orbital about an axis other than an axis that lies in the horizontal or vertical plane. During an exercise session, a user may perform various sets of motions, including sets of different motions. For example, a user may first perform a set of linear oscillating motions followed by a set of orbital motions. The user may vary extension of their arms 205, from fully extended to partially extended. For example, the user may perform linear or orbital oscillations, moving the device from against the user's chest to a distance away whereby the user's arms are only partially extended, or substantially fully extended, or fully extended. Additionally, a user may perform oscillating motions while fully extending one and only partially extending the other arm. In all motions for a method according to principles of the invention, the user oscillates the device 100 at a high frequency to transform the liquid contents from a static state to a dynamic state in which hydrodynamic forces are generated.

Figure 13:
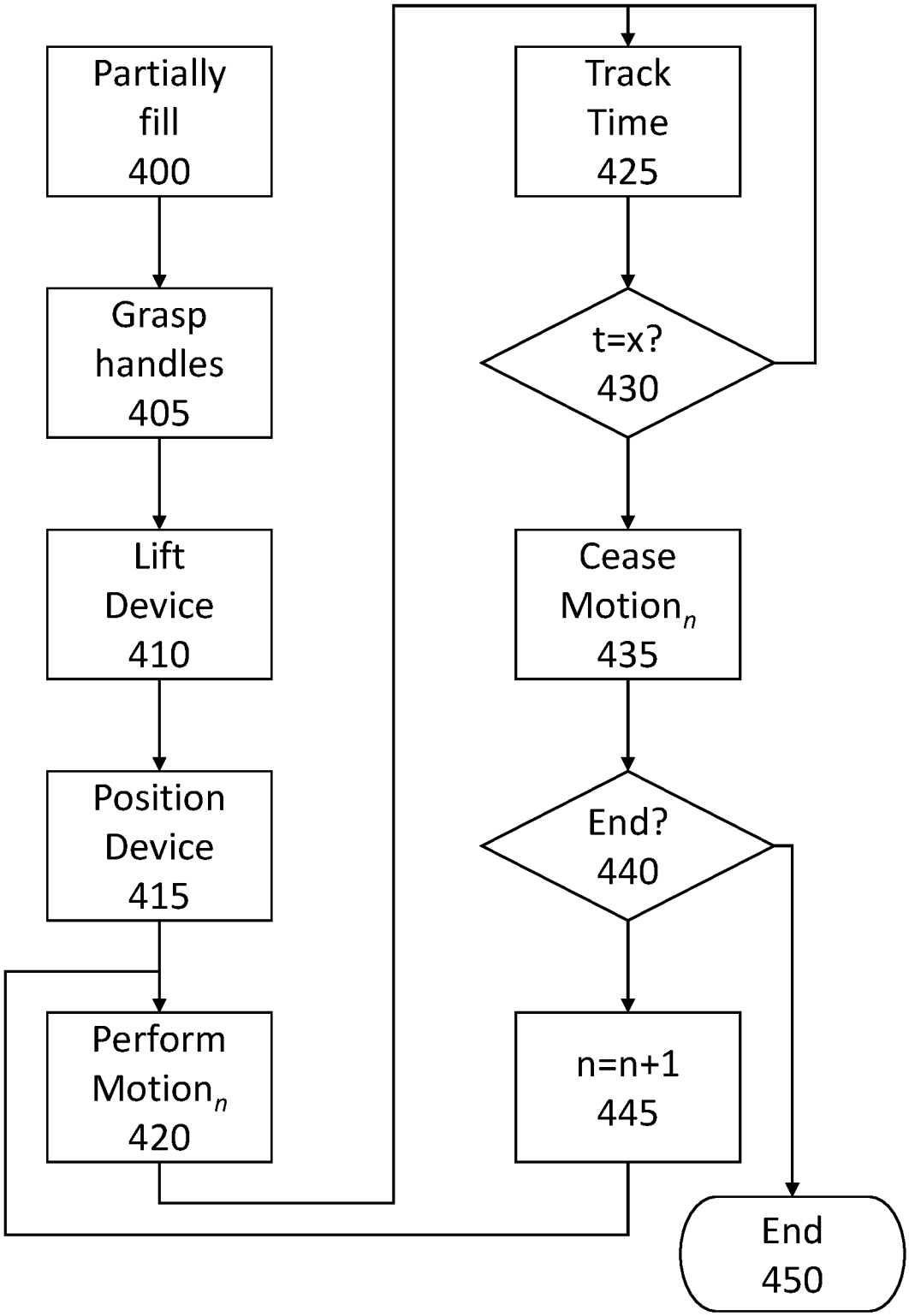
FIG. 13 is a flowchart that conceptually illustrates steps of an exemplary method of exercise sing an exemplary exercise device according to principles of the invention.

FIG. 13 is a flowchart that conceptually illustrates steps of an exemplary method of exercise sing an exemplary exercise device according to principles of the invention. In step 400 the hollow body (e.g., spherical shell 105) of the exercise device 100, through the port 120, is partially filled with water and any additive(s). After partially filling, as in step 105, the port 120 is closed to prevent leakage. It is important that the hollow body is only partially filled, to maintain sufficient space within the hollow body for sloshing flow. If the hollow body is fully filled, or even substantially filled, there will be insufficient space to generate appreciable hydrodynamic forces.

After the hollow body is partially filled, a user grasps both handles 110, 115, as in step 405. The user grasps one handle with one hand, and the other handle with the user's other hand. The user should grasp the handles 110, 115 with sufficient force to maintain control of the device 100 throughout the exercise method.

After grasping the handles 110, 115 as in step 405, the user lifts the device 100, as in step 410. The user should lift the device to a height desired for the first exercise set. By way of example and not limitation, the user may lift the device 100 to a height about equal to the height of the user's chest or shoulders.

After lifting the device 100, as in step 410, the user positions the device 100 for the first exercise set, as in step 415. Such positioning may entail moving the device towards or away from a particular part of the user's body and orienting the device 100 for the first exercise set.

After the device 100 is positioned for the exercise set, as in step 415, the user imparts high frequency oscillating excitations (movements) to the device 100, such as by moving the user's arms in linear and/or orbital motions while grasping the handles 110, 115 and supporting the weight of the device 100. The user starts by performing motion for the first exercise set as in step 420. As the user may perform several sets, each having its own motions, the motions for the different sets may be designated with a subscript n, where n is from 1 to z, z being associated with the last set to be performed by the user. While the method allows any number of sets to be performed, the invention is not limited to an exercise session with a plurality of sets. At least one set suffices.

In step 425, a user may track time, t. The user may continue the set, and continue tracking time as in step 425, until the user has performed the motion for a time duration, x, designated for the set, as in step 430.

After completing the motion for the time duration, the user may cease that motion, as in step 435. The user may rest.

Next, the user decides whether or not proceed with another set of motions, as in step 440. If the user will perform another set, control passes to step 445 and then to step 415, whereupon the user positions the device 100 for the next set. Incrementing n by 1 in step 445 is symbolic, indicating that the user will perform the motion for the next set. The motion may be the same as or different from the motion performed in the preceding set. The user proceeds with steps 420-440 for the new step. This sequence of steps is repeated until the user has performed all motions for all sets, whereupon, in accordance with step 450, the method ends.

A method of exercise according to principles of the invention does not require full arm extension. Rather, the distance of shaking (i.e., oscillating) motion may be relatively small compared to full range of arm extension.

A method of exercise according to principles of the invention allows considerable variation of motions. A user may start an exercise session at a particular position and orientation, and then change the position and orientation throughout a session, and throughout a set. During an exercise session, a device according to principles of the invention may be shaken in as many different positions and motions as possible while maintaining a high frequency (2 Hz or more) harmonic rhythm.

A method of exercise according to principles of the invention consumes considerable energy and requires considerable work in a relatively short period of time. In as little as five minutes, the muscles of a user may go through 750 repetitions (cycles) and at fifteen minutes that number is 2,250 repetitions, assuming the user stays at the preferred frequency of 2.5 Hz.

A method of exercise according to principles of the invention accommodates users over a wide range of fitness levels and strengths. A small version of the device may weigh about 3 pounds, while a larger version of the device may weigh over 20 pounds. By way of example and not limitation, a user of an exercise device according to principles of the invention may start with a device that only weighs 5 pounds, but as strength and endurance increases, fluid can be added to reach 12 pounds or even more. Additionally, a user may progress from a small lightweight device to a larger heavier device.

The relatively high frequency motion liquid weight, shifting center of mass and hydrodynamic forces activates muscles much more efficiently and creates a greater demand on the muscles than the slow movements of typical weight lifting. This high frequency load on the muscles stimulates growth, increases endurance, improves reaction speed, and improves strength. A method of exercise according to principles of the invention simultaneously uses strength and fast twitch to produce a more effective work out in a reduced amount of time than compared to typical weight lifting. By varying the position and type of movement all upper body muscles are activated to grow. Movements with a device according to principles of the invention are almost unlimited, which allows for complicated muscle activity that is not possible with conventional weights.

The complex, infinite and quick movements achievable with this device trains the fast twitch response of the muscles which not only increases size, stamina, and strength, but also teaches the muscles to work together in ways that simulate the complex actions required for sporting events such as baseball, tennis, and golf. It frees the user from the simple linear movements to which typical weight training is limited.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A method of exercise comprising partially filling an exercise device with water, the exercise device comprising a hollow body with an internal compartment having a volume, a pair of handles, a fill port in the hollow body, and a plug in the fill port, the hollow body being symmetrical about two perpendicular planes and having a diameter of at least 6 inches, the pair of handles being on opposite sides of the hollow body, the step of partially filling comprising introducing water into the internal compartment, the hollow body being comprised of a flexible material initially in a collapsed condition, and the step of partially filling the exercise device with water comprising a step of transforming the hollow body to an uncollapsed configuration before introducing water into the internal compartment, said water occupying 30% to 70% of the internal compartment;

grasping each handle of the exercise device partially filled with water;

lifting the exercise device;

positioning the exercise device at a determined height and orientation; and moving the exercise device in an oscillating orbital manner at a frequency of 2 Hz to 4 Hz to transform the water in the internal compartment to a dynamic state producing hydrodynamic forces and an oscillating center of mass.

2. The method of exercise according to claim 1, the frequency being at least 2.5 Hz.

3. The method of exercise according to claim 1, the volume being about 110 cubic inches to 1450 cubic inches.

4. The method of exercise according to claim 1, the exercise device with the hollow body partially filled with water having a weight from about 2.9 lbs to 22.9 lbs.

5. The method of exercise according to claim 1, the hollow body being spherical and having an outer diameter of about 6 to 14 inches.

6. The method of exercise according to claim 1, the step of partially filling further comprising adding, to the water, a viscosity modifier to increase viscosity.

7. The method of exercise according to claim 1, the step of partially filling further comprising adding, to the water, beads for producing an audible effect in the dynamic state.

8. The method of exercise according to claim 1, the step of moving the exercise device in an oscillating orbital manner at a frequency of 2 Hz to 4 Hz to transform the water in the internal compartment to a dynamic state producing hydrodynamic forces and an oscillating center of mass comprising continuing movement of the exercise device in the oscillating orbital manner for a determined period of time.

9. The method of exercise according to claim 1, the step of moving the exercise device in an oscillating orbital manner at a frequency of 2 Hz to 4 Hz to transform the water in the internal compartment to a dynamic state producing hydrodynamic forces and an oscillating center of mass comprising continuing movement of the exercise device in the oscillating orbital manner for a determined number of cycles.

10. The method of exercise according to claim 1, further comprising a step of moving the exercise device in an oscillating linear manner.

11. The method of exercise according to claim 1, the step of moving the exercise device in an oscillating orbital manner comprising moving the exercise device in an oscillating orbital manner about an axis other than an axis that lies in a horizontal or a vertical plane.

12. The method of exercise according to claim 1, the step of moving the exercise device in an oscillating orbital manner at a frequency of 2 Hz to 4 Hz to transform the water in the internal compartment to a dynamic state producing hydrodynamic forces and an oscillating center of mass comprising continuing movement of the exercise device in the oscillating orbital manner for a determined first set.

13. The method of exercise according to claim 12, after completing the first set, repositioning the exercise device at a second height and second orientation; and from the second height and second orientation, moving the exercise device in an oscillating orbital manner at a frequency of 2 Hz to 4 Hz to transform the water in the internal compartment to a dynamic state producing hydrodynamic forces and an oscillating center of mass.

14. The method of exercise according to claim 13, the step of, from the second height and second orientation, moving the exercise device in an oscillating orbital manner at a frequency of 2 Hz to 4 Hz to transform the water in the internal compartment to a dynamic state producing hydrodynamic forces and an oscillating center of mass comprising continuing movement of the exercise device in the oscillating orbital manner for a determined second period of time.

15. The method of exercise according to claim 1, the step of moving the exercise device in an oscillating orbital manner at a frequency of 2 Hz to 4 Hz to transform the water in the internal compartment to a dynamic state producing hydrodynamic forces and an oscillating center of mass comprising continuing movement of the exercise device in the oscillating orbital manner for a determined second number of cycles.

16. The method of exercise according to claim 1, wherein the hollow body, pair of handles, and fill port are integrally formed.

17. The method of exercise according to claim 16, wherein the hollow body, pair of handles, and fill port are integrally formed by rotational molding.

18. The method of exercise according to claim 1, wherein the pair of handles are separately formed from the hollow body and attached to the hollow body.

19. A method of exercise comprising partially filling an exercise device with water, the exercise device comprising a hollow body with an internal compartment having a volume, a pair of handles, a fill port in the hollow body, and a plug in the fill port, the hollow body being symmetrical about two perpendicular planes and having a diameter of at least 6 inches, the pair of handles being on opposite sides of the hollow body, the step of partially filling comprising introducing water into the internal compartment, the hollow body being comprised of a flexible material initially in a collapsed condition, and the step of partially filling the exercise device with water comprising a step of transforming the hollow body to an uncollapsed configuration before introducing water into the internal compartment, said water occupying 30% to 70% of the internal compartment;

grasping each handle of the exercise device partially filled with water;

lifting the exercise device;

positioning the exercise device at a determined height and orientation;

moving the exercise device in an oscillating manner, the oscillating manner including an oscillating orbital manner, at a frequency of at least 2.5 Hz to transform the water in the internal compartment to a dynamic state hydrodynamic forces and an oscillating center of mass for one of a determined period of time or determined number of cycles.

* * * * *